US006446318B1

(12) United States Patent
Foose

(10) Patent No.: US 6,446,318 B1
(45) Date of Patent: Sep. 10, 2002

(54) INSTALLATION TOOL FOR AUTOMOTIVE WHEEL BALANCE WEIGHTS

(76) Inventor: Michael Foose, 2 Eagle Cir., Denver, PA (US) 17517

( * ) Notice: Subject to any disclaimer, the term of this patent is extended or adjusted under 35 U.S.C. 154(b) by 0 days.

(21) Appl. No.: 09/659,031

(22) Filed: Sep. 11, 2000

(51) Int. Cl.[7] ..... B25F 1/00
(52) U.S. Cl. ..... 29/275
(58) Field of Search ..... 254/131; 29/275, 29/254, 255, 243.56

(56) References Cited

U.S. PATENT DOCUMENTS

| | | | | | |
|---|---|---|---|---|---|
| 947,391 | A | | 1/1910 | Michael | |
| 2,314,145 | A | | 3/1943 | Kalajian | |
| 2,491,860 | A | | 12/1949 | Ingraham | |
| 2,586,087 | A | * | 2/1952 | Reynolds et al. | 29/275 |
| 2,641,379 | A | * | 6/1953 | Barbaro | 29/275 |
| 2,652,733 | A | * | 9/1953 | Gilda | 29/275 |
| 3,519,087 | A | | 7/1970 | Santi | |
| 3,793,656 | A | * | 2/1974 | Songer et al. | 254/131 |
| 3,852,839 | A | * | 12/1974 | Blessing | 254/131 |
| 3,900,058 | A | | 8/1975 | McArdle | |
| 4,458,415 | A | | 7/1984 | Maher et al. | |
| 4,610,188 | A | | 9/1986 | Hallock | |
| 4,682,412 | A | | 7/1987 | Pfeffer | |
| 4,834,342 | A | | 5/1989 | Padgett | |
| 4,903,882 | A | * | 2/1990 | Long | 29/275 |
| 4,974,685 | A | * | 12/1990 | Coffenberry | 29/275 |
| 5,492,039 | A | | 2/1996 | Haikal et al. | |
| 5,605,271 | A | | 2/1997 | Russell | |
| 5,791,056 | A | | 8/1998 | Messina | |
| 5,875,950 | A | | 3/1999 | Nuss et al. | |
| 5,875,951 | A | | 3/1999 | Ingle et al. | |
| 5,934,139 | A | | 8/1999 | Tucker | |
| 6,009,626 | A | | 1/2000 | Lei | |
| 6,036,073 | A | | 3/2000 | Newhouse | |

* cited by examiner

*Primary Examiner*—Robert C. Watson
(74) *Attorney, Agent, or Firm*—E. Alan Uebler, P.A.

(57) ABSTRACT

A tool for holding and installing clip-on type wheel balancing weights to be affixed to pneumatic automobile and truck tire rims is provided. The tool may be used to quickly, conveniently, accurately, permanently and painlessly install clip-on type wheel weights, from the largest available to the smallest desirable, for precision balancing of automotive tires.

13 Claims, 2 Drawing Sheets

INSTALLATION TOOL FOR AUTOMOTIVE WHEEL BALANCE WEIGHTS

BACKGROUND OF THE INVENTION

This invention relates to tools for installing wheel weights at optimum circumferential locations in the balancing process for vehicular, pneumatic automobile and truck tires. Present computerized wheel balancing apparatus generally requires an operator to install various sized weights, from as large as three ounces to as small as one-fourth ounce, at a number of determined locations around the tire to achieve accurate balancing. The present method of installation requires the operator to grasp such weight between thumb and forefinger, place it at the designated location, and mount it to the rim by hitting it with a weight hammer. This process is labor intensive, even when using the most sophisticated computerized positioning equipment, time consuming, and often is painful to the person installing these weights.

Impact tools are known for various uses. A nail holding and driving tool is disclosed, for example, in U.S. Pat. No. 6,036,073 and in other prior art references cited in the disclosure statement submitted or to be submitted with this application. Impact tools for cracking ice are known (U.S. Pat No. 6,009,626), for breaking glass (U.S. Pat No. 5,791, 056), and for chopping various materials (U.S. Pat. No. 4,458,415). Magnetic chucks are also known for holding various workpieces, such as screws held by magnetic screwdrivers and tin lids held by magnetic can openers. U.S. Pat. No. 4,610,188 discloses a tool for driving metallic fasteners, which tool includes a magnetic driving head used with pneumatic power hammers and includes an integrally formed shank having a mounting or base portion and a driving head.

Although tire balancing using steel or lead weights has been employed for a very long time, see, e.g., U.S. Pat. No. 2,314,145 (1943) for a description of a tool for removing such weights, the conventional method for installing such weights has improved little over past years. That technique is, essentially, to first determine the optimum sizes and locations of weights to be placed on the wheel rim by dynamic, computer controlled, inertial, high speed, sophisticated, tire rotational apparatus, following which the technician holds the appropriate weight at the designated location on the tire rim with his thumb and fingers and whacks it with a hammer. If missed, as is too often the case, the technician suffers.

The present invention obviates many, indeed most, of the problems inherent in such tire balancing methods, and provides a convenient tool for installing, quickly, efficiently, accurately and painlessly, such wheel weights.

SUMMARY OF THE INVENTION

A holding and driving impact tool for installing wheel weights onto rims of automotive wheels at designated circumferential rim locations is provided. The tool includes an elongate housing having a first end and a second end, the housing containing therein a spring-loaded piston assembly which extends from the first end, through the center of the housing, to and through the second end and extending externally thereof to expose the head of the piston externally of the second end. The piston extends to the first end of the housing and there at is in adjacent proximity to magnetic holding means which are affixed to the housing at the first end. The magnetic holding means are capable of holding any one of the variety of wheel balance weights in present use in the balancing of pneumatic auto and truck tires.

In the preferred embodiment, the first end of the housing is shaped substantially in the form of a"V", and the magnetic holding means comprises a magnet embedded within the first end of the housing within one arm of the"V" and is flush with the surface of the arm of the"V".

The piston assembly is preferably removably installed within the housing and affixed therein by means of snap ring and groove means proximate the second end of the housing. The tool housing may be generally cylindrical in shape and may have a knurled external surface thereof to provide enhanced gripping capability. The housing may have one or more flat surfaces formed in proximity to the first end thereof, for enhanced visibility of the balance weights, and the housing may have one or more longitudinal guide lines imprinted thereon proximate the first end, to enhance guiding the tool during impaction.

DETAILED DESCRIPTION OF THE INVENTION AND PREFERRED EMBODIMENTS WITH REFERENCE TO THE DRAWINGS

An impact tool for holding and driving balancing weights to be applied to pneumatic automobile and truck tire rims is provided. The tool may be used to quickly, conveniently, accurately, permanently and painlessly install wheel weights, from as large as three ounces to the smallest available, for precision balancing of present automotive tires.

Figure 1:
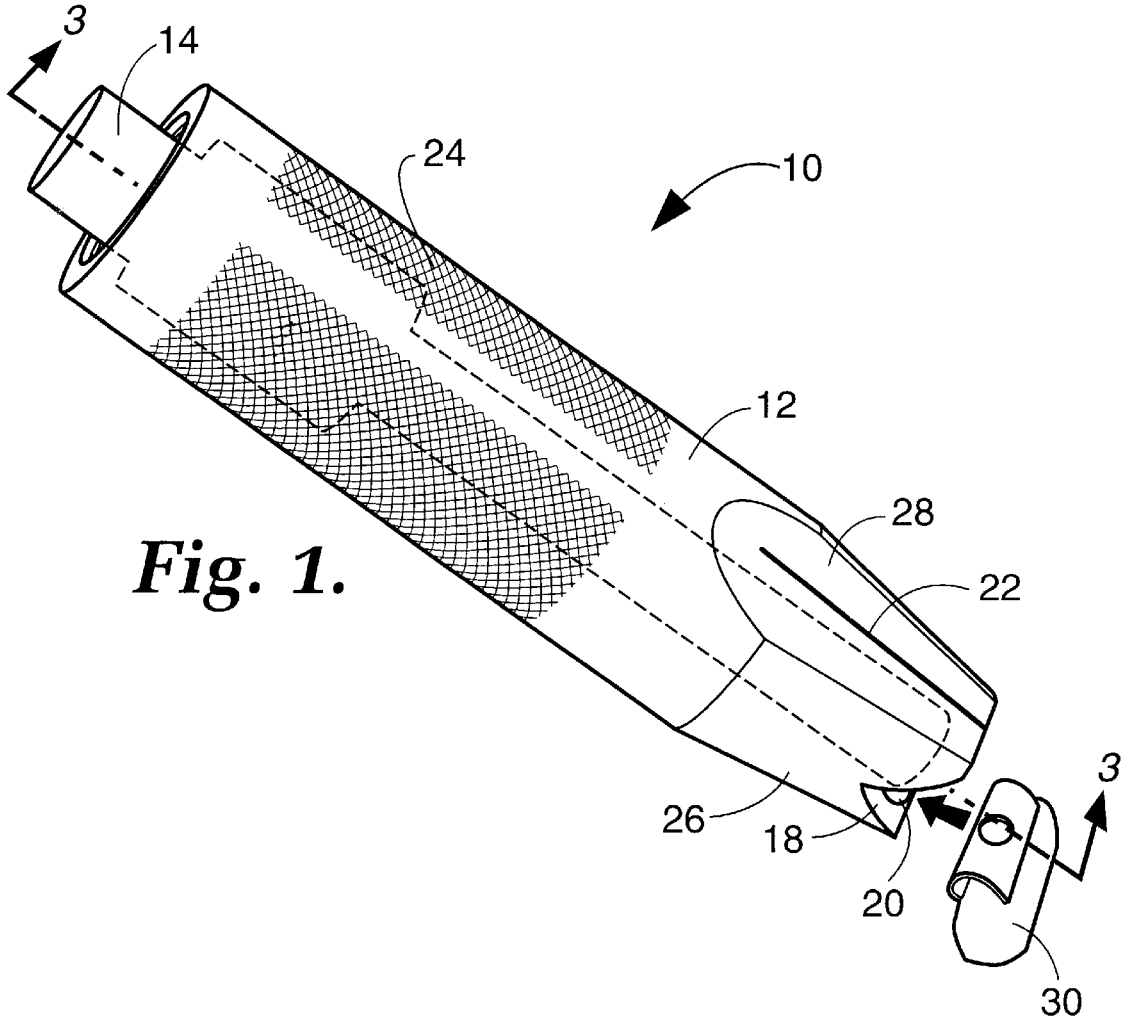
FIG. 1 is an overall isometric view of the impact tool of the invention.

A detailed description of the invention and preferred embodiments is best provided with reference to the accompanying drawings, wherein FIG. 1 depicts an overall view of the impact tool according to the invention. Therein, the tool 10 is shown to include housing 12 which houses the spring-loaded, impact piston 14 as shown. The piston 14 extends through the housing 12 from a first end, at the right of FIG. 1, which preferably has a"V"-groove shape 18 as shown, whereat a wheel weight 30 is placed and held there by the magnet 20 which is embedded within the housing 12 and preferably has its surface flush with one arm of the"V"-groove 18. The wheel weight 30 is placed near the first end of housing 12 in an orientation such that the clip opening of weight 30 faces outwardly in preparation for its application to a tire rim, and the force of magnet 20 then attracts and releasably affixes the weight 30 to the first tool end within the"V", as indicated by the bold arrow.

Preferably the external tapered faces 26, 28, or"flats", are provided to give a better view of the workpiece 30 and tire rim during use. Also provided is one or more guidelines 22 near the application (first) end of the tool 10, providing enhanced guiding and"aiming" capabilities. In addition, knurling 24 may be provided on the external surface of the housing 12 to provide enhanced gripping means for the tool 10.

The piston 14 extends through the housing 12 and outwardly of the housing 12 at its second end thereof, at the left of FIG. 1 as shown. This exposed end of piston 14 is the impact end, the operation of which is described fully below.

In the conventional process of applying weights around the circumference of a pneumatic tire wheel rim, at specified intervals to achieve near-perfect balance of the wheel assembly, the final operation of the technician is to grasp an appropriate weight with thumb and forefinger, place it at the designated rim position, and hit it with a hammer. This is true even with the most sophisticated, computerized, dynamic rotational balancing apparatus available today. Weights to be applied currently range in size down to one-fourth ounce, resulting in time-consuming, and often painful, applications of such weights when using an errant hammer, even one having a rubber cover as presently employed in these operations. The tool 10 of the invention obviates these difficulties and enables precision placement of weights of three ounces and smaller and driving them onto a wheel rim quickly, efficiently, and with no chance of injury to the operator. When the impact end of the piston 14 is struck with the hammer, the weight is forced onto the rim and affixed there at instantaneously.

Figure 2:
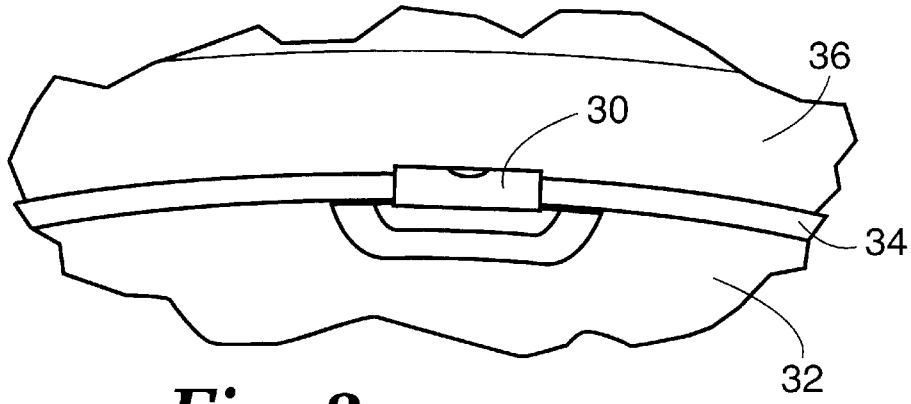
FIG. 2 is a fragmental, perspective view of a wheel weight (30) installed on the rim (34) of a pneumatic tire (36).

FIG. 2 shows an applied weight 30 affixed to the rim 34 of wheel 32 on which is mounted pneumatic tire 36.

Figure 3:
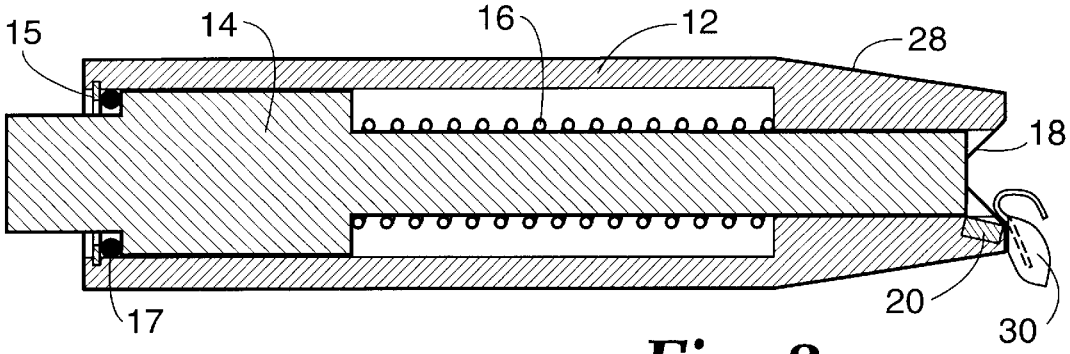
FIG. 3 is an elevational cross-sectional view, taken along line 3—3 of FIG. 1 of the impact tool according to the invention.

A cross-section of the tool 10 is provided in FIG. 3 and illustrates a preferred embodiment. Therein, housing 12 contains the reciprocating piston assembly, which includes the piston 14 guided through the center bore of the housing 12 as shown and acted (or re-acted) upon by spring 16. The piston/spring assembly is contained within the housing 12 and secured therein by snap ring 15."O"-ring 17 may be provided to give some cushioning effect to the impact blows when using this tool.

At the workpiece (first) end of the tool, i.e., the right end shown in FIG. 3, a weight 30 is depicted held in place for application to a tire by the magnet 20, embedded within the "V" arm of the housing 12. The housing 12 may be constructed of any suitable, rugged, non-magnetic material, and aluminum or high-impact plastic is preferred. The piston 14 may be of any rugged material and steel is preferred. The magnet 20 may be any one of a number of magnets strong enough to hold in place the range of available wheel weights. One such magnet is the 15⁄64" diameter, ¼, thick, No. 5856K4 magnet available from McMaster-Carr Corporation.

Figure 4:
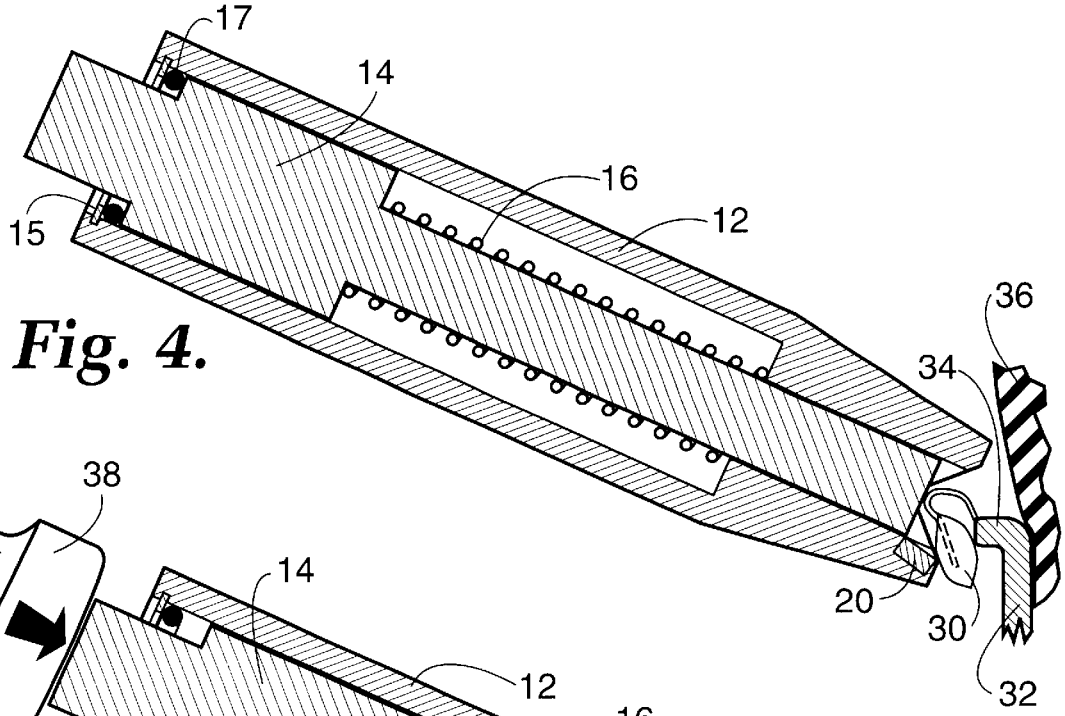
FIG. 4 is a cross-section of the tool of the invention in use at the instant just prior to installing the wheel weight (30) on the rim (34).
Figure 5:
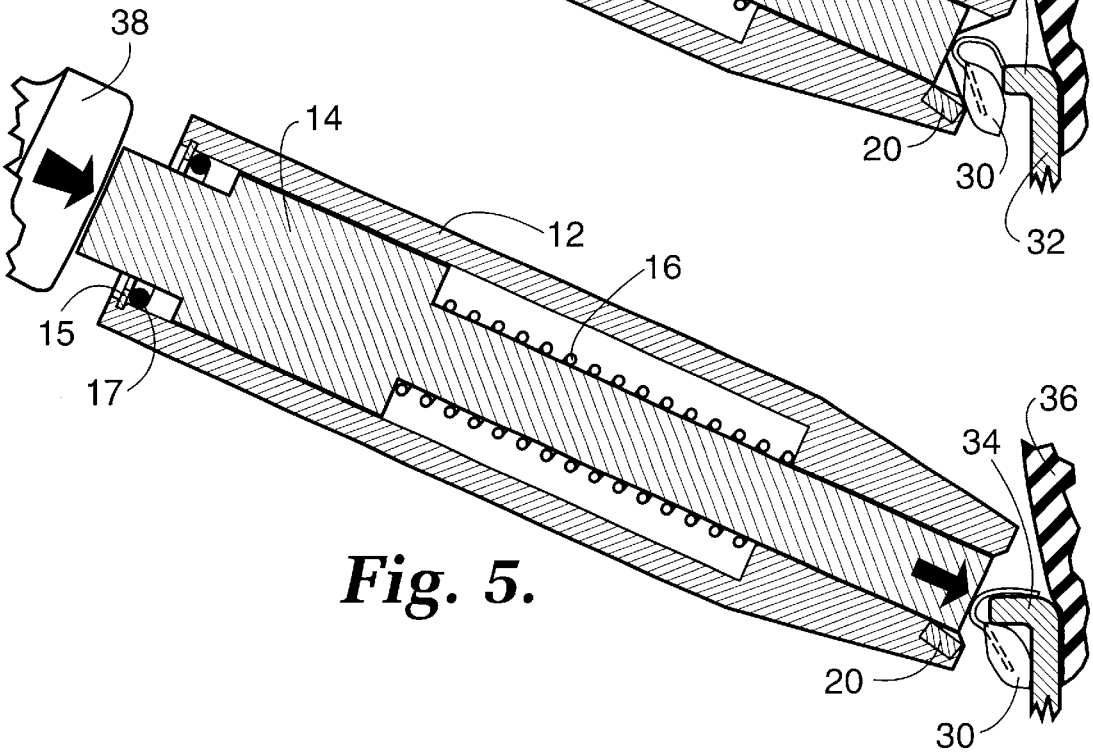
FIG. 5 is an elevational view, partly in cross-section, depicting the moment of impact of the driving force (38) on the piston (14), thereby affixing the weight (30) to the rim (34), all as indicated by the arrows shown in the figure.

FIG. 4 depicts, in a cross-sectional view, the use of the tool 10 in applying a wheel weight 30 to the rim 34 of a pneumatic tire 36 mounted upon wheel 32. Therein, the tool holding the magnet 20 in proper position for application of the weight 30 to the rim 34 is held adjacent the tire and angled as shown. Then, as shown in FIG. 5, which is identical to FIG. 4 in significant details, the hammer 38 is caused to strike the impact end of piston 14, thereby driving the clip of weight 30 onto the rim 34, as indicated by the bold arrows, and thus affixing the weight to the rim. After impact, spring 16 returns the piston to its rest position, ready for the application of additional weights.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A holding and driving impact tool for installing wheel weights onto rims of automotive wheels at designated circumferential rim locations, said tool comprising:

an elongate housing having a first end and a second end, the housing containing therein a spring-loaded piston assembly, wherein said piston assembly is removably installed within said housing and affixed therein by means of snap ring and groove means proximate the second end of said housing, said piston extending from said first end, through the center of said housing, to and through said second end and extending externally thereof to expose the head of said piston externally of said second end, the piston extending therefrom to said first end of the housing and there at being in adjacent proximity to a magnetic holding means affixed to said housing at said first end in proximity thereto, said magnetic holding means being capable of holding any one of a variety of wheel balance weights.

2. The impact tool of claim 1 wherein the first end of said housing is shaped substantially in the form of a"V", and the magnetic holding means comprises a magnet embedded within the first end of the housing within one arm of the"V" and is flush with the surface of said arm of the"V".

3. The tool of claim 2 having said piston assembly removably installed within said housing and affixed therein by means of snap ring and groove means proximate the second end of said housing.

4. The tool of claim 2 wherein said housing is generally cylindrical in shape.

5. The tool of claim 2 wherein said housing has a knurled external surface thereof to provide enhanced gripping capability.

6. The tool of claim 2 wherein said housing has one or more flat, tapered surfaces formed in proximity to the first end thereof, for enhanced visibility of said balance weights and tire rim.

7. The tool of claim 2 wherein said housing has one or more longitudinal guide lines imprinted thereon proximate said first end to enhance guiding said tool during impaction.

8. The tool of claim 6 wherein said housing has one or more longitudinal guide lines imprinted thereon on one or more of said flat surfaces, to enhance guiding said tool during impaction.

9. The tool of claim 1 wherein said housing is generally cylindrical in shape.

10. The tool of claim 1 wherein said housing has a knurled external surface thereof to provide enhanced gripping capability.

11. The tool of claim 1 wherein said housing has one or more flat, tapered surfaces formed in proximity to the first end thereof, for enhanced visibility of said balance weights and tire rim.

12. The tool of claim 1 wherein said housing has one or more longitudinal guide lines imprinted thereon proximate said first end to enhance quiding said tool during impaction.

13. The tool of claim 11 wherein said housing has one or more longitudinal guide lines imprinted thereon on one or more of said flat surfaces, to enhance guiding said tool during impaction.

* * * * *